US006758061B1

(12) United States Patent
Croft

(10) Patent No.: US 6,758,061 B1
(45) Date of Patent: Jul. 6, 2004

(54) NIPPLE HUGGER JEWELRY SYSTEM

(76) Inventor: Claudia Croft, 13040 Gandy Blvd., St. Petersburg, FL (US) 33702

( * ) Notice: Subject to any disclaimer, the term of this patent is extended or adjusted under 35 U.S.C. 154(b) by 0 days.

(21) Appl. No.: 10/385,584

(22) Filed: Mar. 11, 2003

Related U.S. Application Data

(60) Provisional application No. 60/410,457, filed on Sep. 12, 2002.

(51) Int. Cl.[7] ..... A44C 15/00; A44C 7/00

(52) U.S. Cl. ..... 63/14.8; 63/11; 63/12; 63/14.1

(58) Field of Search ..... 63/3.1, 11, 123, 63/5.1, 5.2, 15.45; 267/25, 36.1, 154, 228, 229; 132/156

(56) References Cited

U.S. PATENT DOCUMENTS 2,490,285 A * 12/1949 Smith ..... 132/156
4,625,526 A * 12/1986 Milawski ..... 63/14.1
4,987,667 A * 1/1991 Zwart ..... 63/12
5,125,244 A * 6/1992 Zwart ..... 63/14.1
5,184,482 A * 2/1993 Cloud ..... 63/14.1
5,239,841 A * 8/1993 Zwart ..... 63/12
5,526,654 A * 6/1996 Carter ..... 63/14.1
5,784,900 A * 7/1998 Czupryniak ..... 63/3
5,827,170 A * 10/1998 Gebran ..... 600/15
6,082,138 A * 7/2000 Meehan ..... 63/14.8
6,282,921 B1 * 9/2001 Carter ..... 63/12
6,662,598 B2 * 12/2003 Meehan ..... 63/12

* cited by examiner

*Primary Examiner*—J. J. Swann
*Assistant Examiner*—Ruth Rodriguez
(74) *Attorney, Agent, or Firm*—Edward P. Dutkiewicz

(57) ABSTRACT

A wire is fabricated of a semi-rigid material. The wire may be bent by a user. At least three primary sections are formed. A nipple reception circle is located between the primary sections. The circle has a center. Each primary section extends radially outwardly from the center of the circle. A pair of end sections are formed. Two stem sections extend radially from the circle. An interior point is formed. An exterior point is formed. The end sections and the stem sections are oriented in a common plane prior to use. The end and stem sections are movable to an orientation with the end sections overlapped into a locking relationship when the circle encompasses the nipple of a user. The interiors of the primary sections are in holding contact adjacent to at least three spaced points around the nipple of the user.

8 Claims, 5 Drawing Sheets

FIG 1
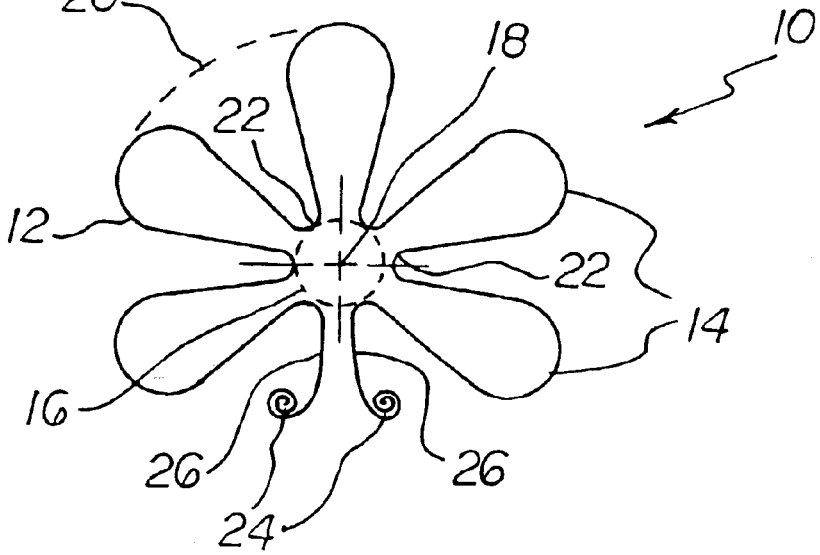
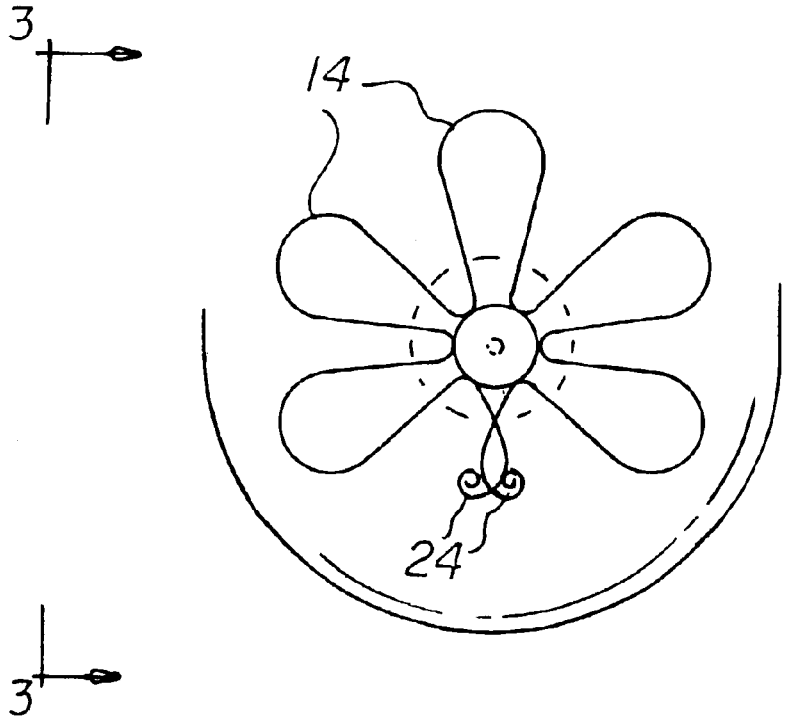
FIG 2

FIG 5
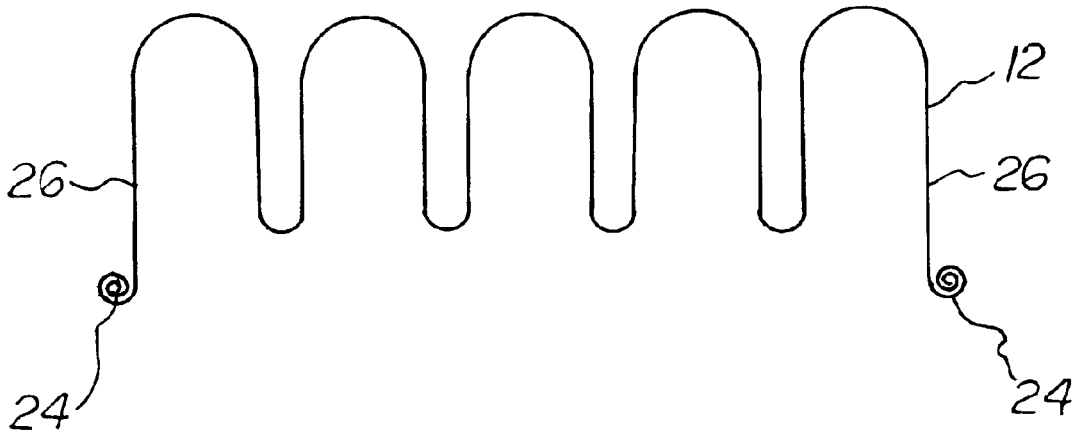
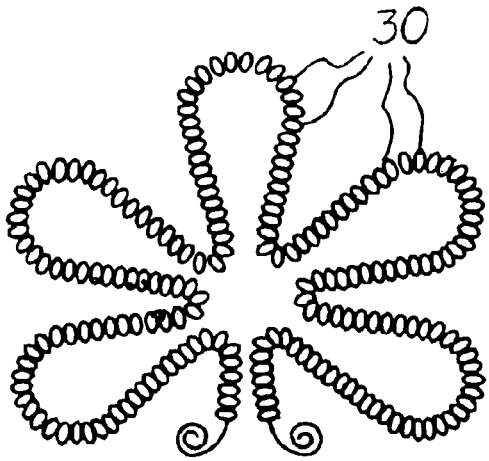
FIG 6

FIG 7
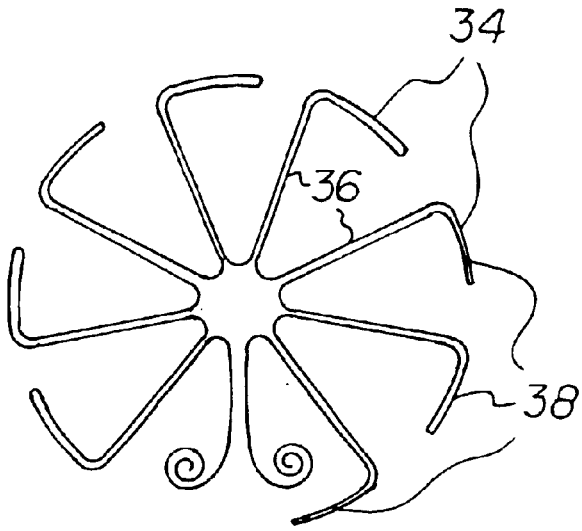
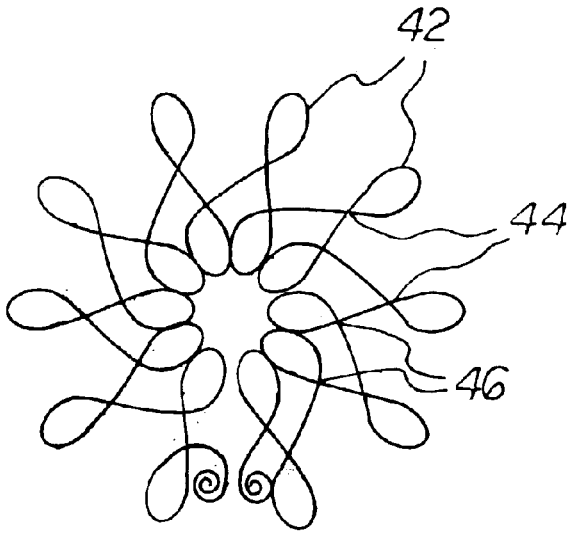
FIG 8

FIG 9
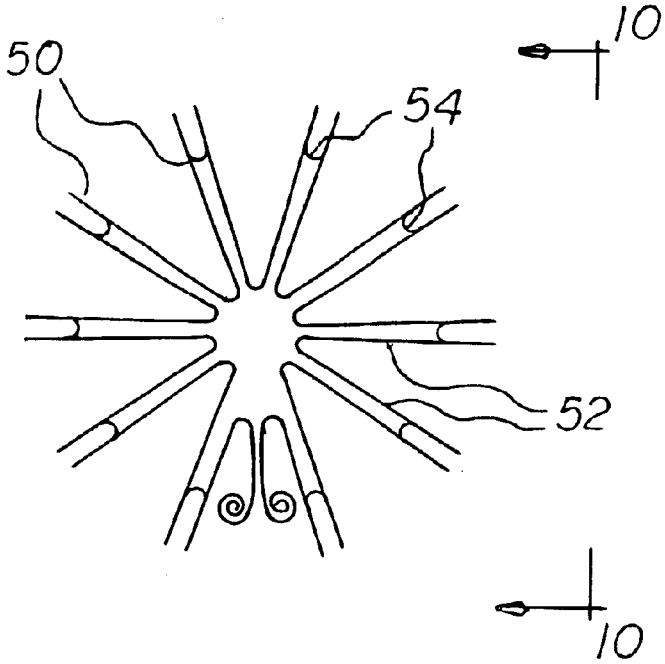
FIG 10
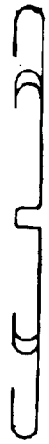
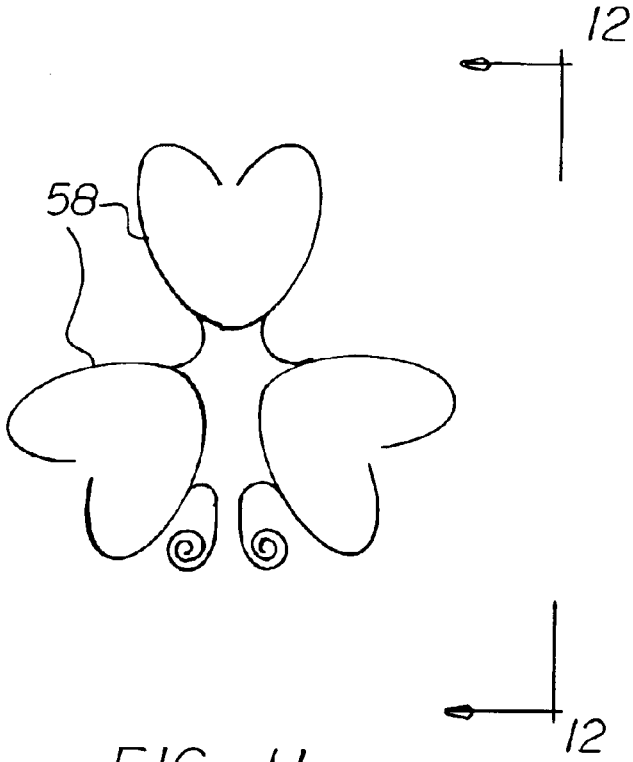
FIG 11
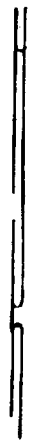
FIG 12

NIPPLE HUGGER JEWELRY SYSTEM

Related Application

The present application is a continuation-in-part application of U.S. Provisional Application Number 60/410,457 filed Sep. 12, 2002.

BACKGROUND OF THE INVENTION

1. Field of the Invention

The present invention relates to a nipple hugger jewelry system and more particularly pertains to adorning the breasts of a user in a non-piercing manner.

2. Description of the Prior Art

The use of jewelry attaching techniques of known designs and configurations is known in the prior art. More specifically, jewelry attaching techniques of known designs and configurations previously devised and utilized for the purpose of providing adornment to a user through conventional methods and apparatuses are known to consist basically of familiar, expected, and obvious structural configurations, notwithstanding the myriad of designs encompassed by the crowded prior art which has been developed for the fulfillment of countless objectives and requirements.

| U.S. Pat. No. | Issue Date | Inventor | Title |
|---|---|---|---|
| 4,626,526 | Dec. 2, 1986 | Milawski | Nipple Decoration Device |
| 5,125,244 | Jun. 30, 1992 | Zwart | Nipple Ring for Decorating a Human Breast |
| 5,239,841 | Aug. 31, 1993 | Zwart | Method of Decorating a Human Breast |
| 6,082,138 | Jul. 4, 2000 | Mechan | Body Ornament |

While these devices fulfill their respective, particular objectives and requirements, the aforementioned patents do not describe a nipple hugger jewelry system that allows adorning the breasts of a user in a non-piercing manner.

In this respect, the nipple hugger jewelry system according to the present invention substantially departs from the conventional concepts and designs of the prior art, and in doing so provides an apparatus primarily developed for the purpose of adorning the breasts of a user in a non-piercing manner.

Therefore, it can be appreciated that there exists a continuing need for a new and improved nipple hugger jewelry system which can be used for adorning the breasts of a user in a non-piercing manner. In this regard, the present invention substantially fulfills this need.

SUMMARY OF THE INVENTION

In view of the foregoing disadvantages inherent in the known types of jewelry attaching techniques of known designs and configurations now present in the prior art, the present invention provides an improved nipple hugger jewelry system. As such, the general purpose of the present invention, which will be described subsequently in greater detail, is to provide a new and improved nipple hugger jewelry system and method which has all the advantages of the prior art and none of the disadvantages.

To attain this, the present invention essentially comprises a wire. The wire is fabricated of a semi-rigid material. The semi-rigid material is preferably a silver based alloy. The wire has a diameter of about 0.030 inches plus or minus 10 percent. In this manner the wire may be readily bent by a user applying a deforming force by hand. In this manner the bent wire will also retain its shape after the removal of the deforming force.

A plurality of primary pedal sections is provided. The pedal section preferably include five pedal sections. The pedal sections are formed from the wire. The pedal sections have a nipple reception circle. The nipple reception circle is located between the pedal sections. The nipple reception circle has a center. Each pedal section extends radially outwardly from the center of the circle. Each pedal section is formed with an essentially semi-circular exterior. The semi-circular exterior has a radius of curvature of about 0.250 inches. Each pedal section is formed with an essentially semi-circular interior. The semi-circular interior has a radius of curvature of about 0.094 inches. The exterior of each pedal is located about 1.5 inches from the center of the circle. The interior of each pedal section is located about 0.250 inch from the center of the circle.

Provided next is a pair of end sections. The end sections are formed from the wire. Each end section is in a spiral shape.

Provided last are two essentially straight stem sections. Each stem section extends radially from the circle. Each stem section has an interior point about 0.250 inches from the center of the circle. The steam sections are formed as extensions of adjacent pedal sections. The stem sections have an exterior point about 0.500 inch from the center of the circle formed as extensions of the end sections. The pedal sections, the end sections, and the stem sections are oriented in a common plane prior to use. The pedal sections, the end sections, and the step sections are also movable to an orientation. The end sections overlap into a locking relationship when the circle encompasses the nipple of a user. The interiors of the pedal sections are in holding contact at five spaced points around the nipple of the user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved nipple hugger jewelry system which has all of the advantages of the prior art jewelry attaching techniques of known designs and configurations and none of the disadvantages.

It is another object of the present invention to provide a new and improved nipple hugger jewelry system which may be easily and efficiently manufactured and marketed.

It is further an object of the present invention to provide a new and improved nipple hugger jewelry system which is of durable and reliable constructions.

An even further object of the present invention is to provide a new and improved nipple hugger jewelry system which is susceptible of a low cost of manufacture with regard to both materials and labor, and which accordingly is then susceptible of low prices of sale to the consuming public, thereby making such nipple hugger jewelry system economically available to the buying public.

Even still another object of the present invention is to provide a nipple hugger jewelry system for adorning the breasts of a user in a non-piercing manner.

Another object of the present invention is to cause the nipple of a wearer to get hard and erect which in turn causes sexual stimulation.

Lastly, it is an object of the present invention to provide a new and improved nipple hugger jewelry system. A wire is fabricated of a semi-rigid material. The wire may be bent by a user. At least three primary sections are formed. A nipple reception circle is located between the primary sections. The circle has a center. Each primary section extends radially outwardly from the center of the circle. A pair of end sections are formed. Two stem sections extend radially from the circle. An interior point is formed. An exterior point is formed. The end sections and the stem sections are oriented in a common plane prior to use. The end and stem sections are movable to an orientation with the end sections overlapped into a locking relationship when the circle encompasses the nipple of a user. The interiors of the primary sections are in holding contact along at least three spaced points around the nipple of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a nipple hugger jewelry system constructed in accordance with the principles of the present invention.

FIG. 2 is a front elevational view of the system similar to FIG. 1 but illustrating one device removably coupled to a breast of a user.

FIG. 5 is a plan view of the system prior to the final fabrication but illustrating a first alternate embodiment of the invention.

FIG. 6 is a front elevational view similar to FIG. 1 but illustrating the first alternate embodiment.

FIG. 7 is a front elevational view similar to FIG. 1 but illustrating the second alternate embodiment.

FIG. 8 is a front elevational view similar to FIG. 1 but illustrating the third alternate embodiment.

FIG. 9 is a front elevational view similar to FIG. 1 but illustrating the fourth alternate embodiment.

FIG. 10 is a side elevational view taken along line 10—10 of FIG. 10.

FIG. 11 is a front elevational view similar to FIG. 1 but illustrating the fifth alternate embodiment.

FIG. 12 is a side elevational view taken along line 12—12 of FIG. 11.

The same reference numerals refer to the same parts throughout the various Figures.

DESCRIPTION OF THE PREFERRED EMBODIMENT

Figure 3:
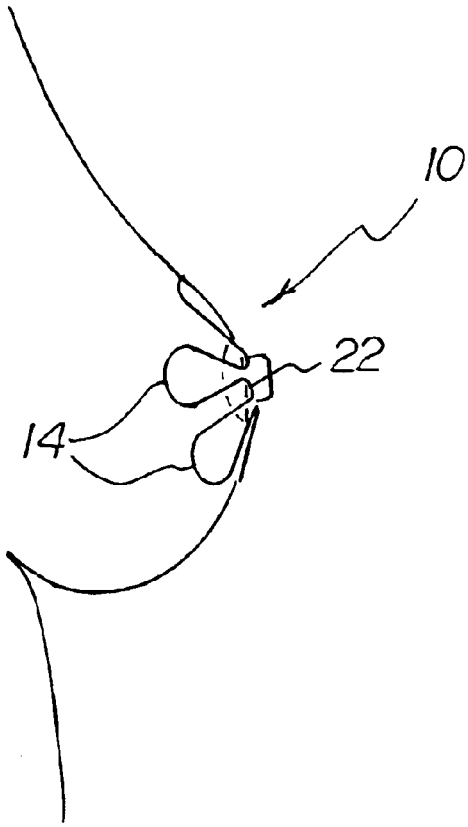
FIG. 3 is a side elevational view of the system similar to FIG. 2.
Figure 4:
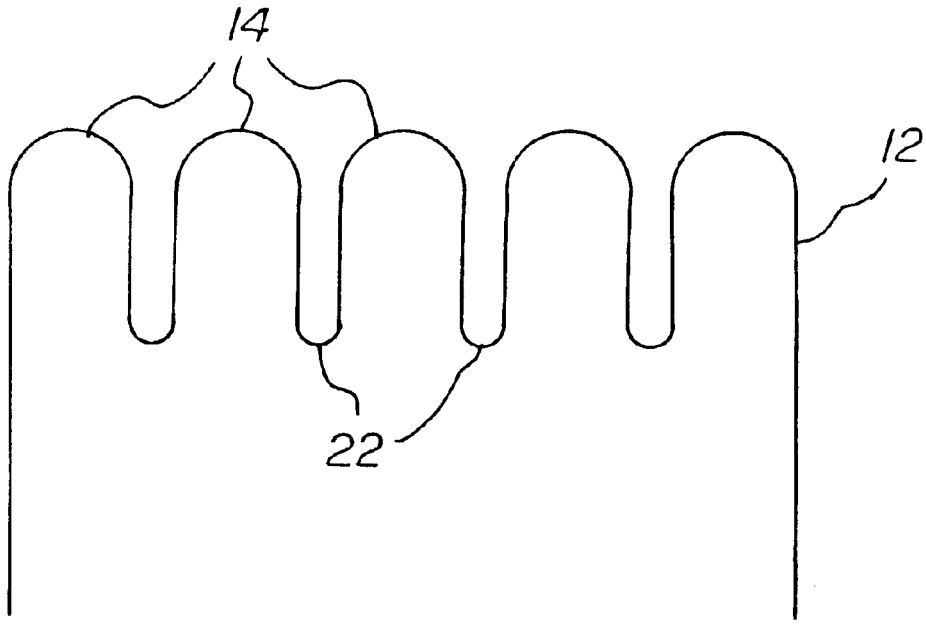
FIG. 4 is a plan view of the system of the prior Figures but prior to the final fabrication.

With reference now to the drawings, and in particular to FIG. 1 thereof, the preferred embodiment of the new and improved nipple hugger jewelry system embodying the principles and concepts of the present invention and generally designated by the reference numeral 10 will be described.

The present invention, the nipple hugger jewelry system 10 is comprised of a plurality of components. Such components in their broadest context include a wire, at least three primary sections, a pair of end sections and two stem sections. Such components are individually configured and correlated with respect to each other so as to attain the desired objective.

First provided is a wire 12. The wire is fabricated of a semi-rigid material. The semi-rigid material is preferably a silver-based alloy such as silver-nickel. The wire has a diameter of about 0.030 inches plus or minus 10 percent. In this manner the wire may be readily bent by a user applying a deforming force by hand. In this manner the bent wire will also retain its shape after the removal of the deforming force.

A plurality of primary pedal sections 14 is provided. The pedal section preferably include five pedal sections. The pedal sections are formed from the wire. The pedal sections have a nipple reception circle 16. The nipple reception circle is located between the pedal sections. The nipple reception circle has a center 18. Each pedal section extends radially outwardly from the center of the circle. Each pedal section is formed with an essentially semi-circular exterior 20. The semi-circular exterior has a radius of curvature of about 0.250 inches. Each pedal section is formed with an essentially semi-circular interior 22. The semi-circular interior has a radius of curvature of about 0.094 inches. The exterior of each pedal is located about 1.5 inches from the center of the circle. The interior of each pedal section is located about 0.250 inch from the center of the circle.

Provided next is a pair of end sections 24. The end sections are formed from the wire. Each end section is in a spiral shape.

Provided last are two essentially straight stem sections 26. Each stem section extends radially from the circle. Each stem section has an interior point about 0.250 inches from the center of the circle. The steam sections are formed as extensions of adjacent pedal sections. The stem sections have an exterior point about 0.500 inch from the center of the circle formed as extensions of the end sections. The pedal sections, the end sections, and the stem sections are oriented in a common plane prior to use. The pedal sections, the end sections, and the step sections are also movable to an orientation. The end sections overlap into a locking relationship when the circle encompasses the nipple of a user. The interiors of the pedal sections are in holding contact at five spaced points around the nipple of the user.

In an alternate embodiment of the present invention the primary sections have essentially spherically-shaped beads 30. Each bead has a diametrically-shaped aperture receiving the wire. Note FIGS. 5 and 6.

In another alternate embodiment of the present invention the primary sections 34 are L-shaped in configuration. The primary sections have a radial long leg 36 and a circumferential short leg 38. Note FIG. 7.

Another alternate embodiment of the present invention provides the primary sections 42 in a generally FIG. 8 shape. Overlaps 44, 46 are provided adjacent to their centers. Note FIG. 8.

In a further alternate embodiment of the present invention the primary sections 50 have generally linear radially interior extents 52. The interior extents are provided in a common first plane. Also provided are generally arcuate exterior extents 54. The exterior extents are provided in planes perpendicular to the first plane. Note FIGS. 9 and 10.

In the last alternate embodiment of the present invention the primary sections 58 are generally heart-shaped. Note FIGS. 11 and 12.

The present invention includes a plurality, preferably three or more, rounded fingers that encircle the base of the nipple of the wearer. Such fingers arouse every sensual desire of the wearer in the area of the wearer adjacent to the fingers. The overall sensation is simply euphoric. This is as close to any aphrodisiac presently known to man.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A nipple hugger jewelry system for adorning a breast of a user in a non-piercing manner comprising, in combination:

a wire fabricated of a silver based alloy having a diameter of about 0.030 inches plus or minus 10 percent whereby the wire may be readily bent by a user applying a deforming force by hand and whereby the bent wire will retain its shape after the removal of the deforming force;

a plurality of primary pedal sections, preferably five pedal sections, formed from the wire with a nipple reception circle located between the pedal sections and with the circle having a center, each pedal section extending radially outwardly from the center of the circle and formed with an essentially semi-circular exterior with a radius of curvature of about 0.250 inches, each pedal section formed with an essentially semi-circular interior with a radius of curvature of about 0.094 inches, the exterior of each pedal being located about 1.5 inches from the center of the circle and the interior of each pedal section being located about 0.250 inch from the center of the circle;

a pair of end sections formed from the wire, each end section being in a spiral shape; and two essentially straight stem sections, each stem section extending radially from the circle with an interior point about 0.250 inches from the center of the circle formed as extensions of adjacent pedal sections and with an exterior point about 0.500 inch from the center of the circle formed as extensions of the end sections, the pedal sections and the end sections and the stem sections lying oriented in a common plane prior to use but movable to an orientation with the end sections overlapped into a locking relationship when the circle encompasses the nipple of a user with the interiors of the pedal sections in holding contact at five spaced points around the nipple of the user.

2. A nipple hugger jewelry system comprising:

a wire fabricated of a semi-rigid material whereby the wire may be readily bent by a user;

at least three primary sections formed from the wire with a nipple reception circle located between the primary sections and with the circle having a center, each primary section extending radially outwardly from the center of the circle;

a pair of end sections formed from the wire; and two stem sections extending generally radially from the circle with an interior point formed as extensions of adjacent primary sections and with an exterior point formed as extensions of the end sections, the end sections and the stem sections lying oriented in a common plane prior to use but movable to an orientation with the end sections overlapped into a locking relationship when the circle encompasses the nipple of a user with the interiors of the primary sections in holding contact along at least three spaced points around the nipple of the user.

3. The system as set forth in claim 2 wherein there are five primary sections, each in the shape of a pedal.

4. The system as set forth in claim 2 wherein the primary sections have essentially spherically-shaped beads, each bead having a diametrically-shaped aperture receiving the wire.

5. The system as set forth in claim 2 wherein the primary sections are L-shaped in configuration with a radial long leg and a circumferential short leg.

6. The system as set forth in claim 2 wherein the primary sections are generally FIG. 8 in shape with overlaps adjacent to their centers.

7. The system as set forth in claim 2 wherein the primary sections have generally linear radially interior extents in a common first plane and also have generally arcuate exterior extents in planes perpendicular to the first plane.

8. The system as set forth in claim 2 wherein the primary sections are generally heart-shaped.

* * * * *